US005230122A

United States Patent [19]

Robinson

[11] Patent Number: 5,230,122

[45] Date of Patent: Jul. 27, 1993

[54] MOUNTING DEVICE FOR WINDOW SHADES

[76] Inventor: Lana Robinson, 1205 Robinson Rd., Old Hickory, Tenn. 37138

[21] Appl. No.: 763,554

[22] Filed: Sep. 23, 1991

[51] Int. Cl.[5] ..... A47H 5/14

[52] U.S. Cl. ..... 16/87.4 R; 160/84.1; 160/368.1; 160/370

[58] Field of Search ..... 160/368.1, 370, 181, 160/84.1; 16/87.4 R, 87.4 W, 87 R, 95 R, 95 W, 95 DW; 211/99, 180; 248/251

[56] References Cited

U.S. PATENT DOCUMENTS

| | | | |
|---|---|---|---|
| 149,770 | 4/1874 | May | 160/84.1 |
| 2,310,014 | 2/1943 | Apfel | 160/84.1 |
| 3,777,800 | 12/1973 | Susoev | 160/84.1 |
| 4,222,492 | 12/1983 | Bledsoe | 160/84.1 |
| 4,317,481 | 3/1982 | Oswald | 160/84.1 |
| 4,718,471 | 1/1988 | Kraeutler | 160/84.1 |
| 5,040,586 | 8/1991 | Hillstrom | 160/368.1 |

FOREIGN PATENT DOCUMENTS

| | | | |
|---|---|---|---|
| 1270759 | 6/1968 | Fed. Rep. of Germany | 160/84.1 |
| 1271921 | 7/1968 | Fed. Rep. of Germany | 160/84.1 |
| 1436957 | 5/1976 | United Kingdom | 160/84.1 |

*Primary Examiner*—Lowell A. Larson
*Assistant Examiner*—Donald M. Gurley
*Attorney, Agent, or Firm*—Casey F. Wilson; Rick R. Wascher

[57] ABSTRACT

A mounting device for hanging window shades hinged along its length, and its opposite edge clamping the top margin of material of the shades in place. A series of channels on the bottom of the mounting device extend the length of the mounting device. Cord guides are suspended below the mounting device and are slidably attached to the mounting device in the channels. The cord guides can be moved to the desired locations on the mounting device and secured in place. The mounting device is attached to the wall with brackets into which the ends of the mounting device are seated.

2 Claims, 2 Drawing Sheets

MOUNTING DEVICE FOR WINDOW SHADES

BACKGROUND OF THE INVENTION

Certain types of window shades and other draperies require special installation. For example, balloon shades, Roman shades, Austrian shades and box pleated draperies require several vertical cords to raise the shades. These cords are spaced parallel to one another across the width of the shades. When the cords are pulled, the ends attached to the shades are pulled upward simultaneously, raising the shades in the manner appropriate to their type.

The top of the shades must be firmly secured to the wall on which they are hung. The traditional method of securing the shades to the wall is to staple or otherwise attach the material at the top of the shades to a wooden mounting board. The wooden mounting board must be cut to fit the window and, for aesthetic reasons, covered. The mounting board is then attached to the wall in a suitable manner. Further, guides for the cords are usually attached to the mounting board. Screw eyes are screwed into the bottom of the mounting board at the locations where vertical cords are required. The cords are placed in the holes of the screw eyes, which then serve as guides for the cords.

The traditional method described above makes difficult the tasks of hanging, removing and replacing the shades (for example, when cleaning the shades). When cleaning the shades, the staples holding the fabric must be removed and the fabric re-stapled when hanging. If the shades are hung incorrectly the process must be repeated. Further, the screw eyes can be repositioned in the mounting board only by removing them from and replacing them in the mounting board.

SUMMARY OF THE INVENTION

The invention is a mounting device for hanging window shades which replaces the wooden mounting board and the screw eyes. The mounting device is hinged along its length, and its opposite edge clamps the material of the shades in place. A channel on the bottom of the mounting device extends the length of the mounting device. Cord guides are suspended below the mounting device and are slidably attached to the mounting device in the channel. The cord guides can be moved to the desired locations along the length of the mounting device and secured in place.

The mounting device permits the removal and replacement of the shades from the wall and the mounting device in a manner that is much simpler than that involved with the use of a wooden mounting board. The material of the shade can be repositioned relative to the mounting device by opening the device about its hinge, repositioning the fabric and again clamping the mounting device shut. The cord guides can be easily repositioned along the length of the mounting device to be used with different types of shades.

DESCRIPTION OF THE PREFERRED EMBODIMENT

Figure 1:
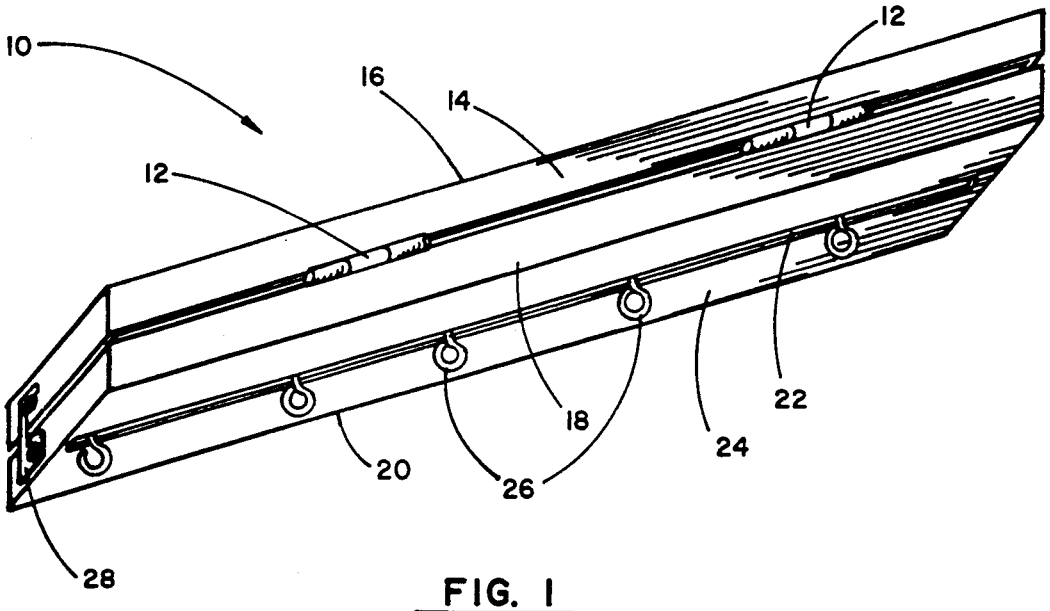
FIG. 1 is a perspective view of the front side of the mounting device.
Figure 2:
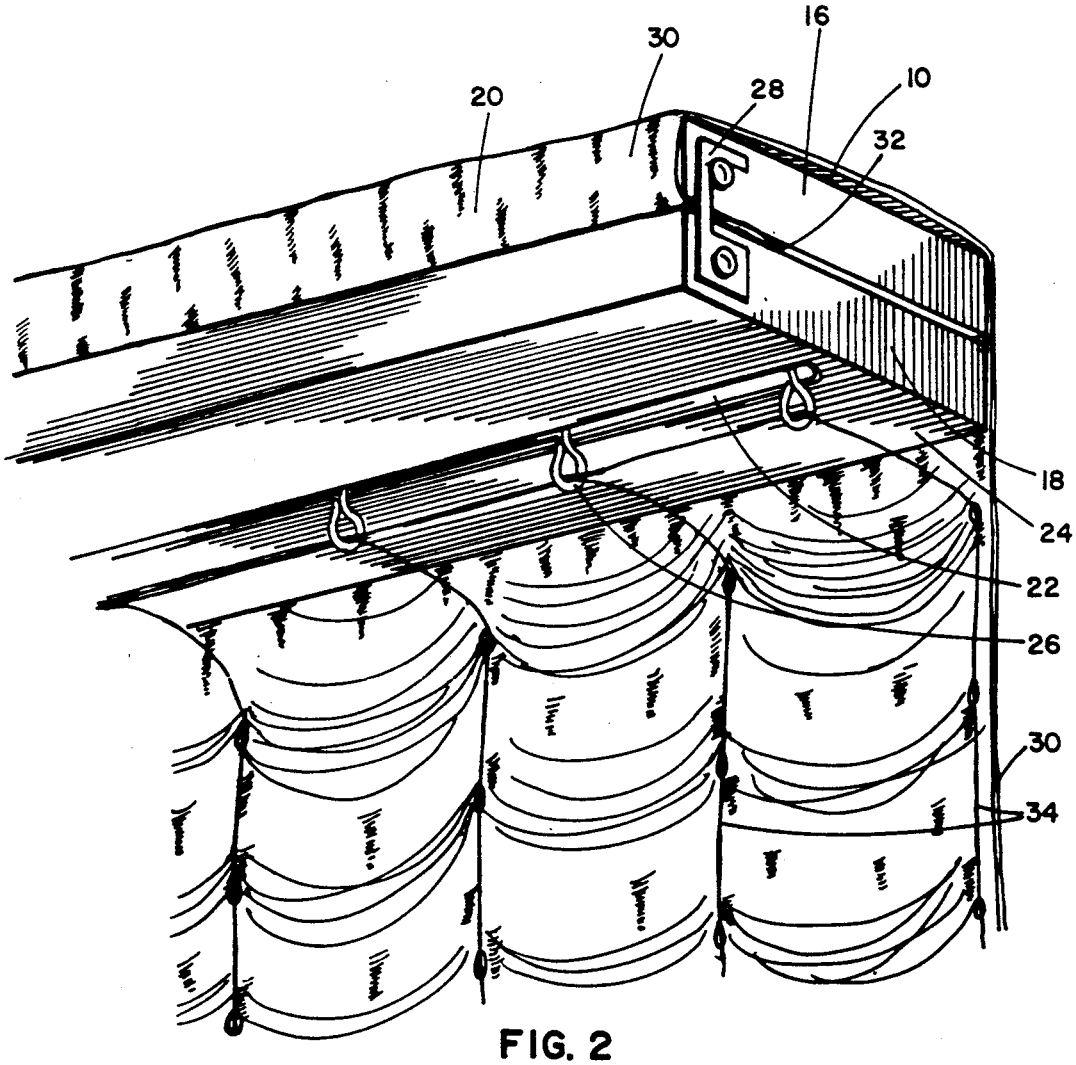
FIG. 2 is a perspective view of the mounting device with a shade mounted therein.
Figure 3:
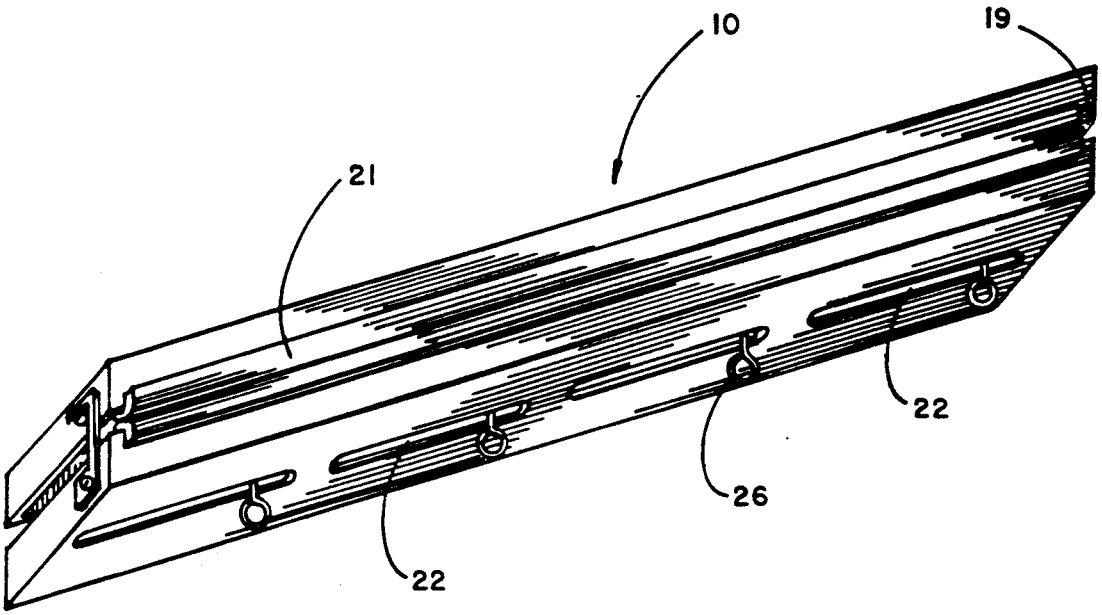
FIG. 3 is a perspective view of the back side of the mounting device.
Figure 4:
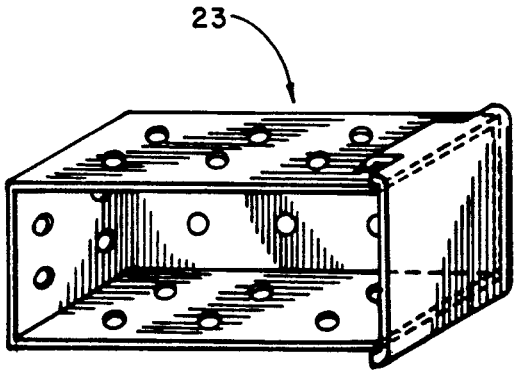
FIG. 4 is a perspective view of the support bracket for the mounting device.

Turning with more particularity to the drawings, the preferred embodiment of the mounting device 10 is shown. The mounting device 10 may be constructed of any suitable material, such as aluminum, plastic, fiberglass or composite material. The mounting device 10 has several hinges 12 extending the length of the mounting device 10 along its front side 14 (the side of the mounting device 10 that will face away from the wall). The hinges 12 permit the mounting device 10 to be opened and closed. The top portion 16 and the bottom portion 18 of the mounting device 10 are fashioned to pivot about the axis formed by the hinges 12. When the mounting device 10 is in the closed position the edges 19 of portions 16 and 18 meet to form the back side 20 (the side of the mounting device 10 that will face the wall when the shade is hung). A guard 21 may be placed along the length of one or both edges 19 to protect the fabric of the shade 30 from being damaged by the edges 19. A plurality of longitudinally arranged slots 22 in the underside 24 of the bottom portion 18 of the mounting device 10 extend along all or almost all the length of the mounting device 10. One or more cord guides 26 are suspended from each slot 22. The cord guides 26 may be slid along the slot 22 to their desired locations and fixed in place. The cord guides 26 are fixed in place by securing with nuts or wing nuts.

In use, the top margin 32 of the shade 30 is placed within the opened mounting device 10. The top and bottom portions 16 and 18 are then closed together and clamp the top margin 32 in place relative to the mounting device 10. The top and bottom portions 16 and 18 are held together by any suitable means, such as pivoting hooks placed over screws. The shade 30 is then draped over and in front of the mounting device 10. The shade cords 34 are positioned in the cord guides 26 in the usual manner. The mounting device is then attached to the wall by means of the bracket 23.

The unique design of the mounting device 10 permits greater ease in removing and replacing the shade 30 from the wall. The top margin 32 of the shade 30 easily can be positioned and repositioned in the mounting device 10 until the correct position is obtained. The cord guides 26 easily can be repositioned in the slot 22. Such repositioning of the cord guides 26 permits redesign of a shade 30 or the use of the same mounting device 10 with different types or styles of shade 30.

It is envisioned that the mounting device 10 can be manufactured in a variety of lengths to be suitable for use with a variety of standard size windows. It is further envisioned that the mounting device can be manufactured in a way that its length is variable, allowing adjustment of the mounting device to fit windows of varying widths.

It will be recognized that the above description of the preferred embodiment of the invention is merely one of many ways in which the invention can be implemented. Other embodiments of the invention will fall within the scope and the spirit of the claims contained herein.

I claim:

1. A mounting device for window shades having a top margin comprising:

(a) two elongated clamping members, each said clamping member having a first edge and a second edge, a first said clamping member having a plurality of longitudinally spaced slots along its length;

(b) a hinge pivotally connecting said clamping members along the first edges thereof;

(c) a means for biasing said second edges of said clamping members against each other and on a top margin of a window shade;

(d) a plurality of guides slidably positioned in said slots;

(e) a pair of brackets adapted to receive and support said clamping members and said window shade; and (f) shade guard means extending along at least one of said second edges of said clamping members for protecting the shade from damage.

2. The mounting device of claim 1 wherein said guides are positioned in said slots by threading into nuts.

* * * * *